US007267228B2

(12) United States Patent
Keffeler et al.

(10) Patent No.: US 7,267,228 B2
(45) **Date of Patent: *Sep. 11, 2007**

(54) COVER ASSEMBLY FOR A MEDICATION DISPENSER

(76) Inventors: Mark G. Keffeler, 21509 Ridgewood Rd., Elkhorn, NE (US) 68022; David P. Keffeler, 6606 N. 144th St., Omaha, NE (US) 68116

( * ) Notice: Subject to any disclaimer, the term of this patent is extended or adjusted under 35 U.S.C. 154(b) by 0 days.

This patent is subject to a terminal disclaimer.

(21) Appl. No.: 11/436,811

(22) Filed: May 18, 2006

(65) Prior Publication Data

US 2006/0201845 A1 Sep. 14, 2006

Related U.S. Application Data

(63) Continuation of application No. 10/197,949, filed on Jul. 17, 2002, now Pat. No. 7,097,037.

(51) Int. Cl.
*B65D 83/04* (2006.01)
*B65D 41/32* (2006.01)

(52) U.S. Cl. ..... 206/532; 206/528; 206/538; 220/266

(58) Field of Classification Search ..... 206/528–540; 220/265, 266, 269, 270, 839, DIG. 34
See application file for complete search history.

(56) References Cited

U.S. PATENT DOCUMENTS 2,529,853 A * 11/1950 Taggart ..... 229/237
3,703,955 A * 11/1972 Inacker ..... 206/532
4,084,695 A * 4/1978 Halbich ..... 206/532
4,253,572 A * 3/1981 Halbich ..... 206/538
4,372,445 A * 2/1983 Keffeler ..... 206/532
4,403,462 A * 9/1983 Halbich ..... 53/392
4,735,318 A * 4/1988 Keffeler ..... 206/532
4,741,441 A * 5/1988 Keffeler ..... 206/532
5,011,018 A * 4/1991 Keffeler ..... 206/532
5,328,046 A * 7/1994 Kutz et al. ..... 220/266
5,735,406 A * 4/1998 Keffeler ..... 206/535
6,631,820 B2 * 10/2003 Harrold et al. ..... 215/237
7,097,037 B1 * 8/2006 Keffeler et al. ..... 206/532
2002/0079282 A1 * 6/2002 Harrold et al. ..... 215/237

* cited by examiner

*Primary Examiner*—Mickey Yu
*Assistant Examiner*—Greg Pickett
(74) *Attorney, Agent, or Firm*—Dennis L. Thomte; Thomte Law Office LLC

(57) ABSTRACT

A cover assembly for a medication dispenser including a container defining a plurality of open-top medication compartments adapted to be closed by a compartment cover assembly including a plurality of individual covers selectively connected together. Each cover includes an integral fracturable tab depending from one end and coacting means on the container for securing the tabs in a snap-fit relationship when the cover is positioned to close its respective compartments. Each tab is independently secured relative to the container and fractured from its respective cover in response to upward movement of the opposite end of the cover to open the compartment. In one embodiment, the tab has a plurality of spaced-apart openings formed therein to create a weakened area to facilitate the separation of the cover from the tab. In another embodiment, a pair of notches extend into the sides of the tab. In another embodiment, which may be used with the other embodiments, a pair of spaced-apart protrusions extend from said tab for pivotal engagement with the dispenser.

3 Claims, 3 Drawing Sheets

COVER ASSEMBLY FOR A MEDICATION DISPENSER

This is a continuation application of Petitioners' earlier application Ser. No. 10/197,949 filed Jul. 17, 2002, now U.S. Pat. No. 7,097,037B1, entitled "COVER ASSEMBLY FOR A MEDICATION DISPENSER".

BACKGROUND OF THE INVENTION

1. Field of the Invention

This invention relates generally to medication dispensers and more particularly to a multiple unit container including several unit-dose compartments. More particularly, this invention relates to a cover assembly for the medication dispenser which includes a plurality of individual covers connected together by fracturable links. Each of the covers includes a fracturable tab having means for facilitating the fracturing of the cover from the link.

2. Description of the Related Art

United States Pharmacopoeia Xix defines a unit-dose container as a single-unit container so designed that the contents are administered to the patient as a single dose, direct from the container. A single-unit container is defined as one that is closed in such a manner that none of the contents may be removed without obvious destruction of the closure, the contents of which are intended for use promptly after it is opened. Accordingly, each compartment of a multiple-unit container must meet the above definitions in order to be used in compliance with current federal regulations. Several such containers have been previously proposed such as those disclosed in U.S. Pat. Nos. 3,921,804 and 4,084,695.

It is desirable in the dispensing of medication to patients that as much chance of error in the administration of the medication be eliminated as is feasibly possible. The package of U.S. Pat. No. 3,921,804 permits a pharmacist to place the unit dosages in the individual compartments and to seal the same therein. A nurse simply breaks the seal on the individual pocket when the dosage is being administered. Although this package has been generally successful, the removal of medication from an individual compartment requires potentially destructive pressure to be exerted against the medication to force it through the perforated seal on the opposite side of the compartment. Furthermore, the slits in the compartment seals may permit the undetected removal of certain forms of medication and finally, the outer shell of that container requires a paper seal or other adhesive means to prevent removal of the entire compartment containing insert therefrom.

In the pillbox of U.S. Pat. No. 4,084,695, the cover assembly for the individual compartments is simply frictionally held in place with no positive locking of the covers onto the compartments to prevent the undetected removal of medication.

The assignee of this invention has previously patented many types of cover assemblies for the medication dispensers with those cover assemblies including a plurality of individual covers connected together by fracturable links. Each of the compartment covers includes an integral fracturable tab adapted to be independently snap-fit onto the container to hold the lines in place and to provide a secure and tamperproof closure of each compartment. In some of the fracturable links, the separation of the link from the remainder of the cover was enhanced by the utilization of a notch formed in the tab positioned adjacent the juncture of the tab to the cover top plate. For example, see U.S. Pat. Nos. 4,372,445; 4,735,318; 4,741,441; and 5,011,018. Although the tabs of the earlier patents identified hereinabove did fracture in a satisfactory manner, it has been found that the fracturing of the tab is more reliably performed in a cleaner and neater manner through the use of the instant invention.

There is also a perception in the field that the covers of the prior art may be slightly raised, without fracturing the tab, so that medication may be removed from the compartment or medication placed in the compartment. Although applicants do not agree that such tampering is possible without fracturing the tab, the instant invention is designed to positively prevent medication tampering. Another perception in the field is that a cover may be removed from its compartment by fracturing the tab thereon with the cover then being able to be replaced on its compartment without the fracturing being visible. In other words, if medication is returned to a pharmacy, the pharmacy must check each individual cover to ascertain if the cover has been fractured since the same is not readily perceptible.

SUMMARY OF THE INVENTION

The cover assembly of this invention is designed for a medication dispenser including a unitary container having several unit-dose compartments formed therein. In some cases, the compartments are formed through the use of a removable liner positioned in the compartment. The covers for the containers each include a depending integral fracturable tab adapted to be independently snap-fitted onto the container. In one embodiment, each of the tabs has a plurality of spaced-apart openings formed therein to provide a weakened area in the tab to enable the top plate of the cover to be separated from the fracturable tab. In another embodiment, V-shaped notches extend into the sides of the tab. In another embodiment, a pair of spaced-apart protrusions extend outwardly from the upper side of the tab for engagement with the container with the protrusions acting as pivot points which aid in the fracturing of the cover from the container. In all the embodiments, the fracturing event is readily visibly apparent.

It is therefore a principal object of the invention to provide an improved medication dispenser container.

Another object of the invention is to provide a medication dispenser wherein each compartment cover includes a depending tab having means associated therewith for positively enabling the top plate of the cover to be separated from the fracturable tab.

Yet another object of the invention is to provide a medication dispenser wherein each compartment cover includes a depending tab having means associated therewith for positively enabling the top plate of the cover to be separated from the fracturable tab with the fracturing event being readily visibly apparent.

These and other objects will be apparent to those skilled in the art.

DETAILED DESCRIPTION OF THE INVENTION

Figure 1:
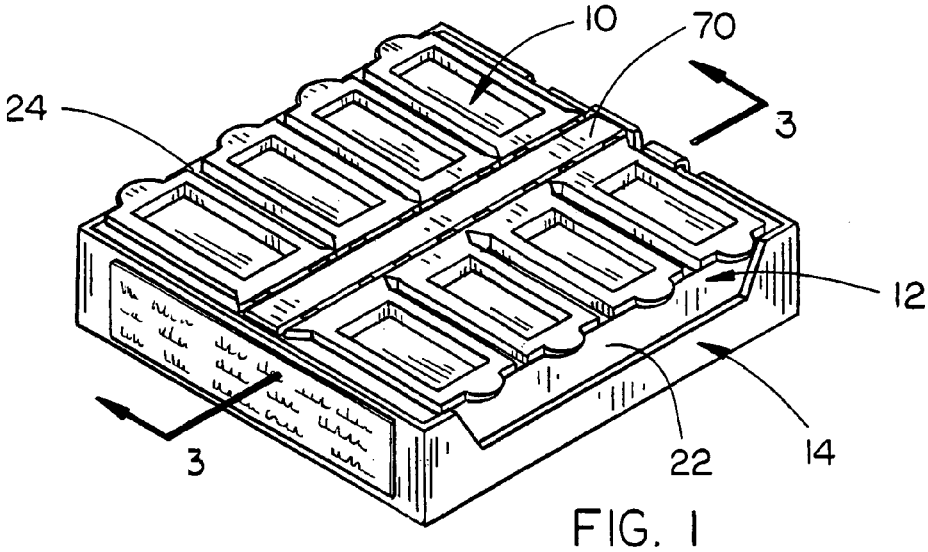
FIG. 1 is a perspective view of a carrier having a medication dispenser positioned therein which has the cover assembly of this invention mounted thereon.
Figure 2:
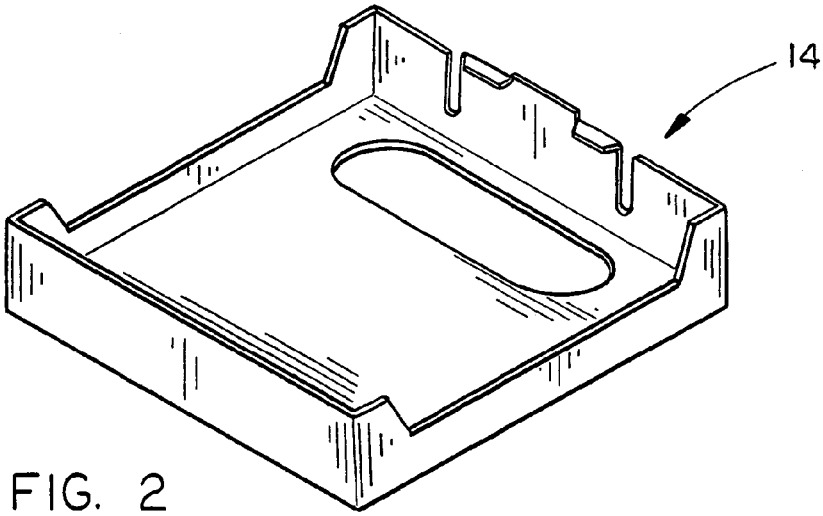
FIG. 2 is a perspective view of the carrier of FIG. 1.
Figure 3:
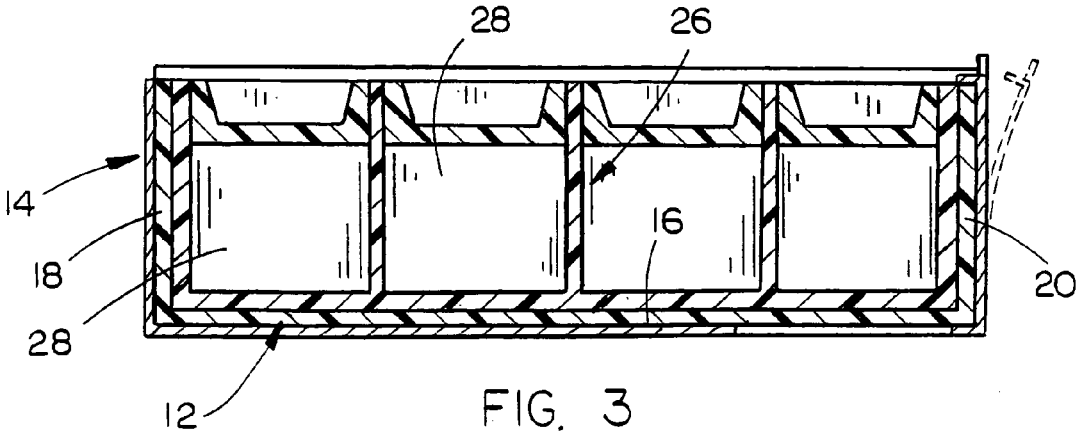
FIG. 3 is a sectional view as seen on lines 3-3 of FIG. 1.

FIG. 1 illustrates the cover assembly 10 of this invention which is mounted on a medication dispenser 12 positioned in a carrier 14. The details of the medication dispenser 12 and carrier 14 are disclosed in U.S. Pat. No. 5,735,406. The medication container or dispenser 12 includes a bottom wall 16, upstanding side walls 18 and 20, and upstanding end walls 22 and 24. Normally, a liner 26 is provided in the dispenser 12 to define a plurality of compartments 28, each of which are removably sealed by a cover 30 of the cover assembly 10.

The unitary cover assembly 10 includes a sufficient number of individual compartment covers 30 for closing all of the compartments 28 of one liner 26. In some cases, it may be that cover assembly 10 will not be unitary but an individual cover 30 will be positioned over the upper end of each compartment 28. However, it is preferred that the cover assembly 10 be unitary.

Each cover 30 is generally trough-shaped and includes a generally horizontally extended bottom 32 and opposite end walls 34 and 36 and opposite side walls 38 and 40 extended upwardly therefrom. A semi-circular extension 42 at the top edge of each end wall 34 facilitates lifting the cover 30 to open a compartment 28. At the top of the inner wall 36, an integral flange 44 extends generally horizontally away from the end wall 36 and flares outwardly to form fracturable links 46 for interconnecting a plurality of covers 30 so that they may be handled as an integral assembly 10.

An important feature of each compartment cover 30 is the locking tab 48 which functions to independently secure each compartment cover 30 to container 12. Each tab is a generally flat, downwardly tapering member arranged parallel to end wall 36. The spacing between tab 48 and end wall 36 is just sufficient for receiving a container divider wall and a liner end wall between them, as illustrated in the drawings. Each tab 48 is further provided with an upwardly facing shoulder 50 on the interior side thereof and a weakened upper portion 52 formed by a plurality of openings 54 which extend through tab 48 adjacent the juncture of the tab to flange 44. Although it is preferred that a pair of the openings 54 be provided adjacent each of the side edges 56 and 58 of the tab 48, it may be that additional openings 54 will be required in some situations and that they be positioned continuously across the tab 48.

Figure 7A:
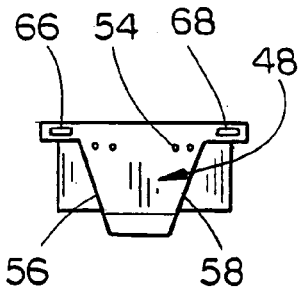
FIG. 7A is an end view of the cover of FIG. 5.
Figure 7B:
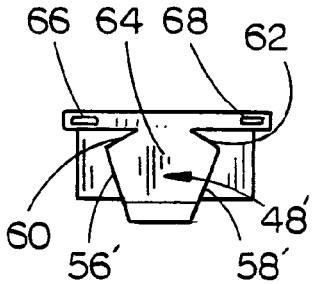
FIG. 7B is a view similar to FIG. 7A except that a modified embodiment of the tab is illustrated.

FIG. 7B illustrates a second embodiment of the tab which is referred to generally by the reference numeral 48'. Tab 48' does not include the openings 54, but is provided with a pair of V-shaped notches 60 and 62 which extend inwardly into the sides of the tab 48' to form a weakened area referred to generally by the reference numeral 64.

Figure 4:
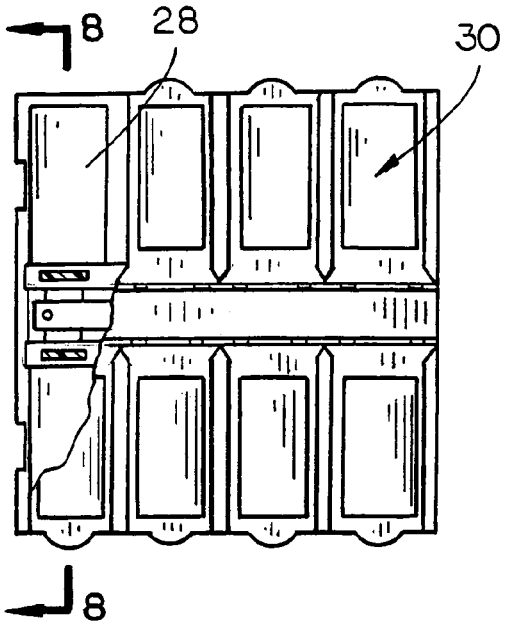
FIG. 4 is a top view of the dispenser with portions of the cover cut away to more fully illustrate the invention.
Figure 5:
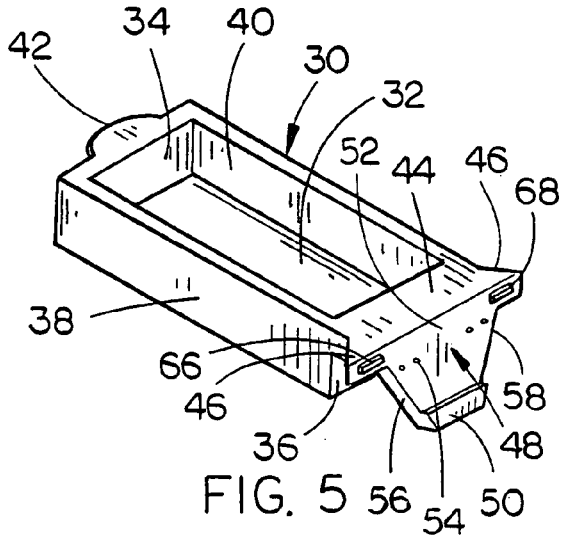
FIG. 5 is a perspective view of one of the individual covers.
Figure 6:
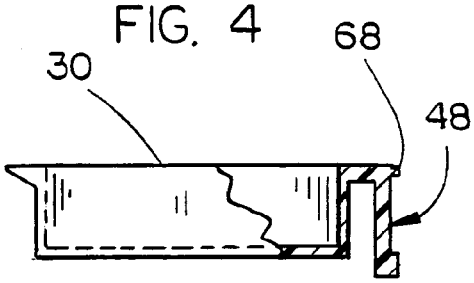
FIG. 6 is a side elevational view of the cover of FIG. 5 with portions thereof cut away to more fully illustrate the invention.
Figure 8:
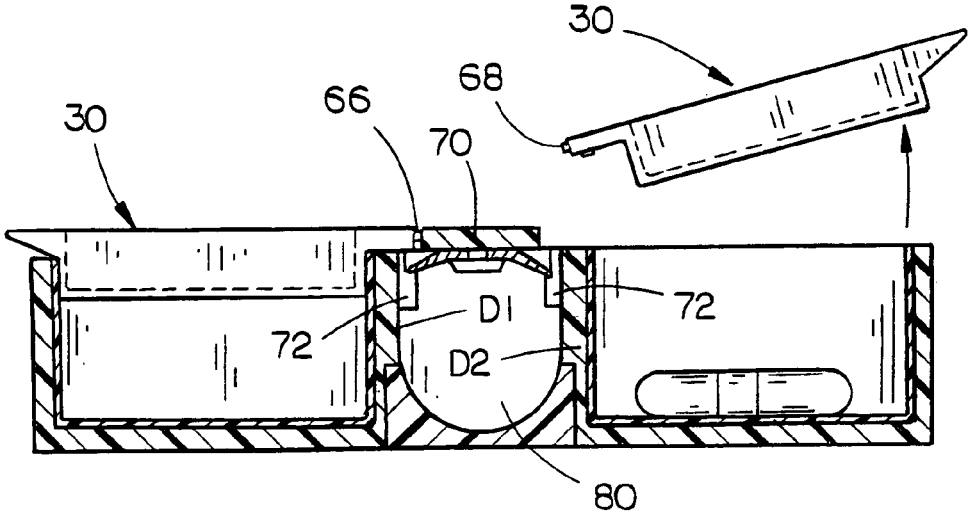
FIG. 8 is a sectional view illustrating a cover being removed from the dispenser.
Figure 9:
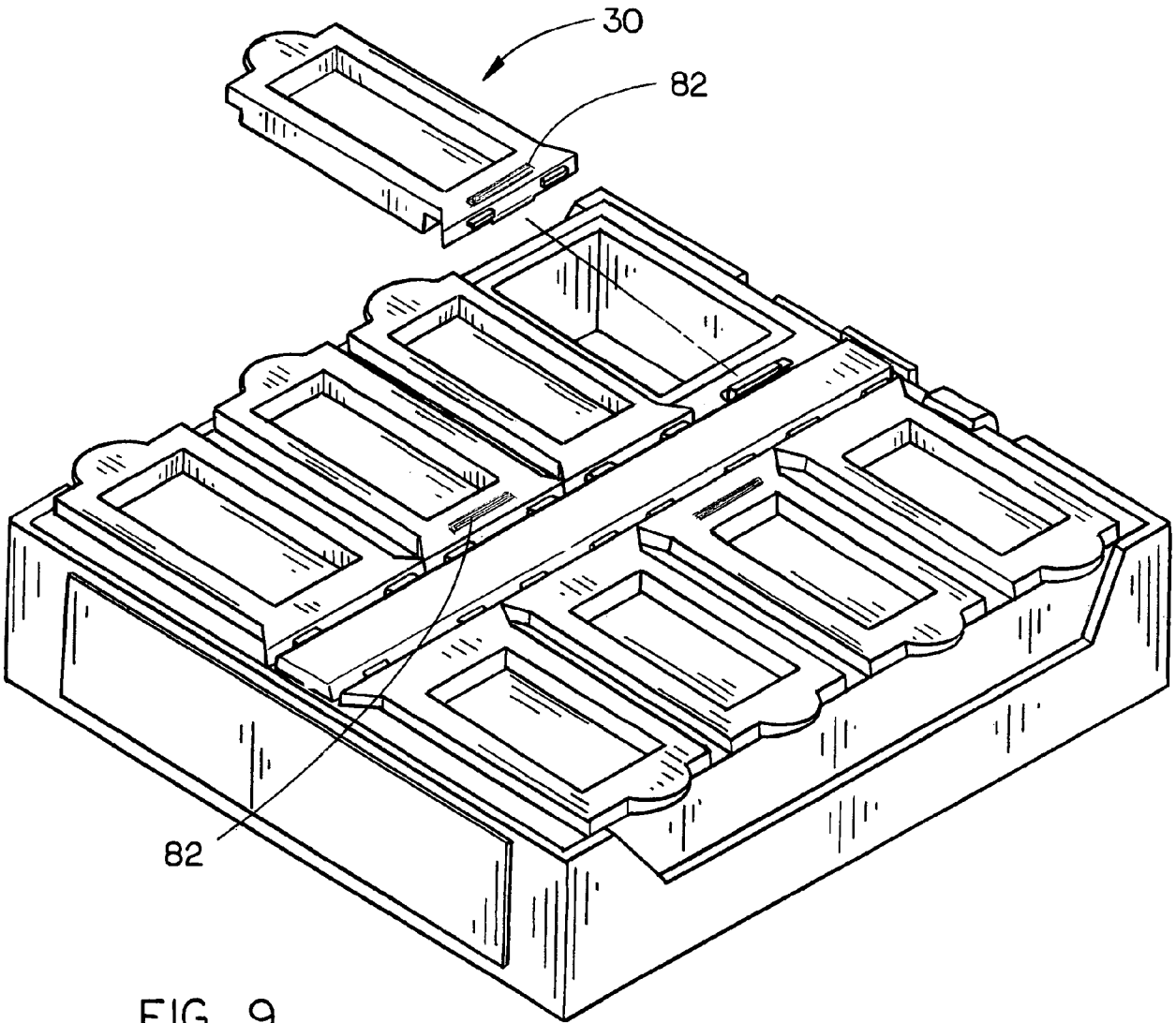
FIG. 9 is a perspective view of the carrier, dispenser and cover assembly which illustrates an individual cover being removed from the dispenser.

FIGS. 5, 6, 7A and 7B illustrate structure on the tab which may be used with either the tabs 48 or 48'. As seen, a pair of protrusions 66 and 68 extend from the tab 48 or 48' for engagement with the top wall 70 of container 12, as seen in FIGS. 4 and 8. The protrusions 66 and 68 act as pivot points against top wall 70 as the cover 30 is moved upwardly thereby enhancing the fracturing of the tab so that cover 30 may be separated from the container.

As best seen in FIG. 8, top wall 70 of container 12 extends between and is connected to the upper edges of both divider walls D1 and D2. The top wall 70 cooperates with the divider walls D1 and D2 to define a plurality of elongated spaced-apart openings 72 for receiving the tabs 48 of the compartment covers 30.

When cover assembly 10 is positioned on the upper end of compartment liner 26, the tabs 48 on each of the covers 30 are received in the openings 72. At the same time the covers 30 are depressed into the individual compartments 28 of the liner 26, the trough-shaped covers 30 close and seal each of the open-top compartments 28. The outwardly protruding semi-circular extension 42 at the outer end of each cover 30 engages the outer side wall of the liner, as shown in the drawings, to positively seat the cover onto and within the liner compartment 26.

When a compartment is to be opened, the outer end of a cover 30 is pivotally moved upwardly which results in a fracture of the tab 48 at the weakened portion 52 formed by the openings 54 or at the weakened portion 64 formed by the notches 60 and 62 with that fracturing being enhanced by the engagement of the protrusions 66 and 68 with the top wall 70 of the container. The fracturable links 46 connecting that cover to adjacent covers are similarly fractured. The openings 54 or the notches 60 and 62 permit the cover 30 to be easily fractured from the lower end of the link 46 in a clean and neat fashion or manner. That portion of the tab 48 which is positioned below the openings 54 or the notches 60, 62 falls into the trough-shaped cavity 80. Regardless of the embodiment, if the tab 48 or 48' is fractured, a "cloudy" area 82 appears to an observer if the cover is not removed from the container or if the cover is replaced on the container.

Thus it can be seen that a novel cover assembly for a medication container or dispenser has been provided which includes means for ensuring that the fracturable tab will easily fracture in a clean and neat fashion or manner.

Thus it can be seen that the invention accomplishes at least all of its stated objectives.

We claim:

1. A cover for use with a medication dispenser having at least one compartment which is selectively closed by the cover, comprising:

said cover having opposite ends, opposite sides, upper and lower ends;

said cover including a separate integral fracturable tab adjacent to one end thereof for locking said cover to said medication dispenser so that said cover closes said compartment;

said tab having a front face and a rear face and opposite side edges;

said tab having a weakened portion formed therein whereby said tab will fracture at said weakened portion to enable said cover to be separated from said tab;

said weakened portion being defined by a first pair of horizontally spaced-apart openings extending through said tab adjacent one of said side edges and a second pair of horizontally spaced-apart openings extending through said tab adjacent the other of said side edges;

and at least a pair of spaced-apart protrusions extending from said front face of said tab for pivotal engagement with said dispenser.

2. A medication dispenser, comprising:

a container comprising at least one upstanding side wall, opposite upstanding end walls, and a divider wall extended between said end walls in spaced relation from one side wall to define a generally trough-shaped cavity;

a multicompartment liner removably insertable into said cavity, said liner defining a plurality of open-topped compartments whereby medication placed within said compartments is maintained out of direct contact with said container;

a plurality of disposable compartment covers, each adapted to overlie and close a respective one of said compartments upon insertion of said liner into said container cavity;

each cover including a separate integral fracturable tab adjacent to one end thereof; coacting lock means on said container and on the individual tabs for independently securing each tab in snap-fit locked relation onto said container to hold the liner therein, each cover being fractured from its respective tab in response to upward movement of the opposite end of said cover to open said compartment;

each of said tabs having a front face and a rear face and opposite side edges;

each of said fracturable tabs having a weakened portion formed therein whereby said tab will fracture at said weakened portion to enable said cover to separate from said tab;

said weakened portion being defined by a first pair of horizontally spaced-apart openings extending through said tab adjacent one of said side edges and a second pair of horizontally spaced-apart openings extending through said tab adjacent the other of said side edges;

and at least a pair of spaced-apart protrusions extending from said front face of said tab for pivotal engagement with said container.

3. A multicompartment liner and cover assembly for a medication dispenser container including at least one upstanding side wall, opposite upstanding end walls and a divider wall extended between said end walls in spaced relation from one side wall to define a generally trough-shaped cavity, and a plurality of cover lock means on said container adjacent said divider wall, said compartment liner and cover assembly comprising:

a multicompartment liner removably insertable into said cavity, said liner defining a plurality of open-topped compartments whereby medication placed within said compartments is maintained out of direct contact with said container;

a plurality of disposable compartment covers, each adapted to overlie and close a respective one of said compartments upon insertion of said liner into said container cavity;

each cover including a separate integral fracturable tab adjacent one end thereof for independent securement to said container;

each tab having a front face and a rear face and opposite side edges;

each tab being fractured from its respective cover in response to upward movement of the opposite end of said cover to open said compartment;

said tab having a weakened portion formed therein whereby said tab will fracture at said weakened portion to enable said cover to be separated from said tab;

said weakened portion being defined by a first pair of horizontally spaced-apart openings extending through said tab adjacent one of said side edges and a second pair of horizontally spaced-apart openings extending through said tab adjacent the other of said side edges;

and at least a pair of spaced-apart protrusions extending from said front face of said tab for pivotal engagement with said container.

* * * * *